United States Patent [19]

Perazza

[11] Patent Number: 4,932,683

[45] Date of Patent: Jun. 12, 1990

[54] MULTI-DOCUMENT FILE FOLDER

[76] Inventor: Justin J. Perazza, 1 Stags Leap Ct., Vincentown, NJ 08088

[21] Appl. No.: 321,625

[22] Filed: Mar. 13, 1989

[51] Int. Cl.[5] ..... B42D 15/00

[52] U.S. Cl. ..... 283/74; 281/42; 283/36; 283/37

[58] Field of Search ..... 40/359, 360; 283/74, 283/36–43; 206/44 B, 45, 425; 281/42

[56] References Cited

U.S. PATENT DOCUMENTS

| | | | |
|---|---|---|---|
| 927,107 | 7/1909 | Bryant | 40/360 |
| 2,229,426 | 1/1941 | Tanner | 206/45 |
| 2,876,907 | 3/1959 | Amberg | 283/42 |
| 3,958,816 | 5/1976 | Remmey, III | 283/38 |
| 4,329,191 | 5/1982 | Barber | 40/359 X |

FOREIGN PATENT DOCUMENTS

| | | | |
|---|---|---|---|
| 77274 | of 1950 | Norway | 283/41 |

*Primary Examiner*—Frank T. Yost
*Assistant Examiner*—Thomas Hamill, Jr.
*Attorney, Agent, or Firm*—Charles F. Duffield

[57] ABSTRACT

A multi-document file folder is disclosed which includes an outer file jacket having front and rear panels and a multi-pocket file folder insert having insert pockets adapted to be positioned within the file jacket. The insert pockets of the insert are of a predetermined depth and are staggered vertically upwardly in a rearward direction to expose the upper edges of the pockets one behind the other. A window within the front panel of the file jacket is provided in alignment with the upper edges of the file folder insert pockets to thus reveal the presence or absence of documents filed within the insert pockets.

4 Claims, 2 Drawing Sheets

MULTI-DOCUMENT FILE FOLDER

BACKGROUND OF INVENTION

The present invention relates to the art of file folders and, more particularly, to file folders for storing multiple documents in a manner that the presence or absence of documents is readily apparent.

In many industrial and/or business environments, a prescribed set of documents will be involved in a given transaction or series of transactions. For example, in the home mortgage industry, a likely series of documents would be a mortgage application, credit report, buyers' affidavit, sellers' affidavit, mortgage, mortgage note, deed and settlement sheet.

In such situations as the business transaction proceeds, i.e. in the case of a home mortgage, it is necessary to continuously review the transaction file to be sure of the presence or absence of such documents and to update the documents. The absence of a necessary document obviously could have a serious delaying effect upon completion of the transaction until the appropriate document is procured.

The most conventional way in which such documents are filed is that they simply are placed in bulk in a given file. Under such circumstances, the presence or absence of given documents can only be ascertained by manually searching through the file to determine the presence of all of the necessary documents.

Some file folders of the prior art include nomenclature on the outer file jacket or spaced lines whereupon the presence of a given document can be indicated as the document is placed within the file. However, this is time consuming in that these entries must be made. Additionally, the fact that an entry was made upon the outer portion of the file jacket does not, in and of itself, assure that the document is, indeed, within the file. Thus, again a manual search must be made of the file to be absolutely certain that the document is present.

In other prior art file folders, the file folder will have separate pockets within which a given document is to be placed but, here again, the absence or presence of the document within its respective pocket must be ascertained by opening the file and physically determining if the required document is within that particular pocket into which it is supposed to have been inserted.

What is desired in the industry is a multi-document file folder into which a plurality of specific documents may be filed and which file folder will permit immediate and instant recognition of the presence or absence of a particular document without the necessity of opening the file. The absence or presence of the document may be ascertained either visually or by the use of machine readable apparatus.

The multi-document file folder of the present invention overcomes the foregoing shortcomings of file folders of the prior art and achieves the required instantaneous recognition of the presence or absence of documents without the necessity of opening the file folder.

SUMMARY OF INVENTION

The multi-document file folder of the present invention includes an outer file jacket having front and rear panels. Positioned within the file jacket is a multi-pocket file folder insert.

The multi-pocket file folder insert includes a plurality of insert pockets of a predetermined depth, for example the width of a particular document to be disposed within that pocket. Each of the pockets are staggered vertically with respect to one another upwardly in a rearward direction to expose the upper edge of the pockets one behind the other.

A window is positioned within the front panel of the file jacket in alignment with the upper edges of the file folder insert pockets. Various nomenclature is positioned upon the exposed upper edges of the insert pockets such as mortgage, note, etc. As the respective documents are placed into their assigned pocket, the upper edges of the documents will be visible through the window. In this manner, the presence or absence of a given document may be instantly ascertained without the necessity of opening the file.

Machine readable encoding material such as bar code, magnetic tape and the like may be used on the exposed edges of the documents to provide automatic machine determination of the presence or absence of a particular document.

Other objects and advantages of the multi-document file folder of the present invention will become apparent from the detailed description thereof which follows.

DETAILED DESCRIPTION OF INVENTION

Figure 1:
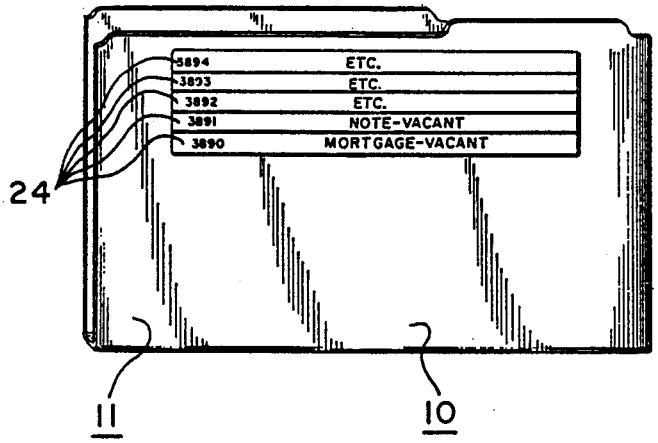
FIG. 1 is a front elevational view of the file folder of the present invention with the file folder insert in place in closed position.

The multi-document file folder 10 of the present invention is shown in FIG. 1 in assembled and closed position. The major components of the file folder are an outer file jacket 11 which includes a front panel 12 and a rear panel 13 hinged together along a common folding line at the bottom edges of the panels. The rear panel 13 includes an upstanding tab 14 upon which such information as client's name, etc. may be placed.

The second major component of the file folder of the present invention is an assembled file folder insert 15. As may best be seen from FIGS. 5 and 5A, the insert 15 includes an outer envelope 16. The outer envelope 16 is formed much like the familiar accordian folder in that it has a front wall 17, back wall 18, bottom wall 19 and opposed end walls 20.

The outer envelope 16 differs from the familiar accordian folder in that the back wall 18 extends substantially higher than normal accordian folders for a purpose to be hereinafter described.

Figure 5:
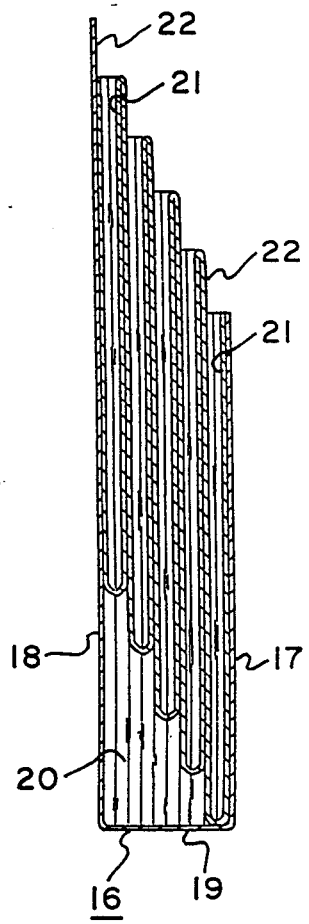
FIG. 5 is an end sectional view of the complete file folder insert of the file folder of the present invention taken along the line 5—5 of FIG. 4.
Figure 5A:
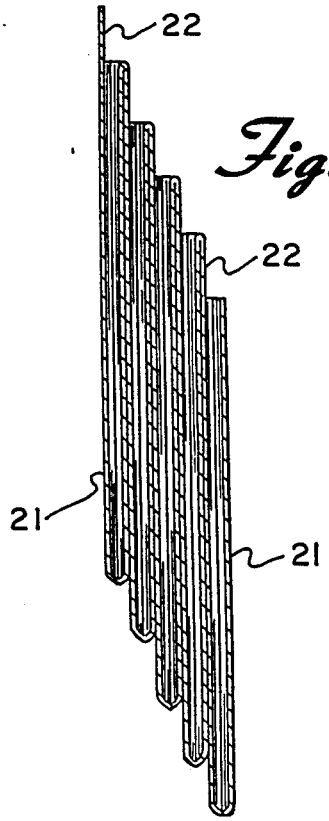
FIG. 5A is an end sectional view of a portion of the file folder insert of the file folder of the present invention prior to assembly within its outer envelope.

The file folder insert 15 further includes a plurality of insert pockets 21 as shown in FIG. 5A. The insert pockets 21 are essentially open ended U-shaped members. They are adhered one to another in a staggered relationship vertically upwardly from the front pocket in a rearwardly direction such that the upper edges 22 are exposed one behind the other and easily in view.

In assembled relationship, the plurality of insert pockets 21 are positioned within the outer envelope 16 as shown in FIG. 5 of the drawings. The outermost panels of the insert pockets 21 may be appropriately secured by an adhesive or the like to the inner surfaces of the front and rear panels 17 and 18 of the outer envelope 16 to thus maintain the insert pockets in place within the outer envelope.

The insert pockets 21 shown in FIGS. 5 and 5A are of an equal depth. The depth of a particular insert pocket 21 may be varied depending upon the particular document that is to be filed within that pocket. Generally, most documents are approximately 8½ inches in width and accordingly the depth of a given insert pocket for such a document including the exposed edge 22 would be approximately 8½ inches. However, the depth of the various pockets may vary depending upon the documents to be filed therein.

Figure 2:
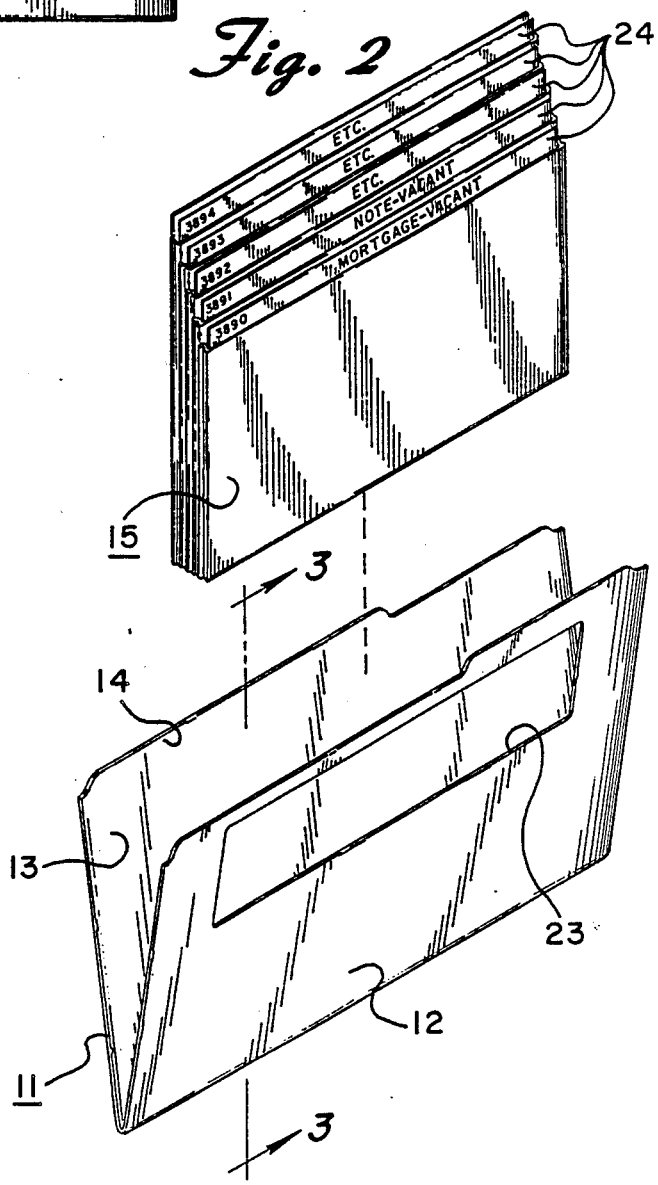
FIG. 2 is a perspective exploded view of the file folder of the present invention with the file jacket partially open showing the file folder insert withdrawn from the file jacket.
Figure 4:
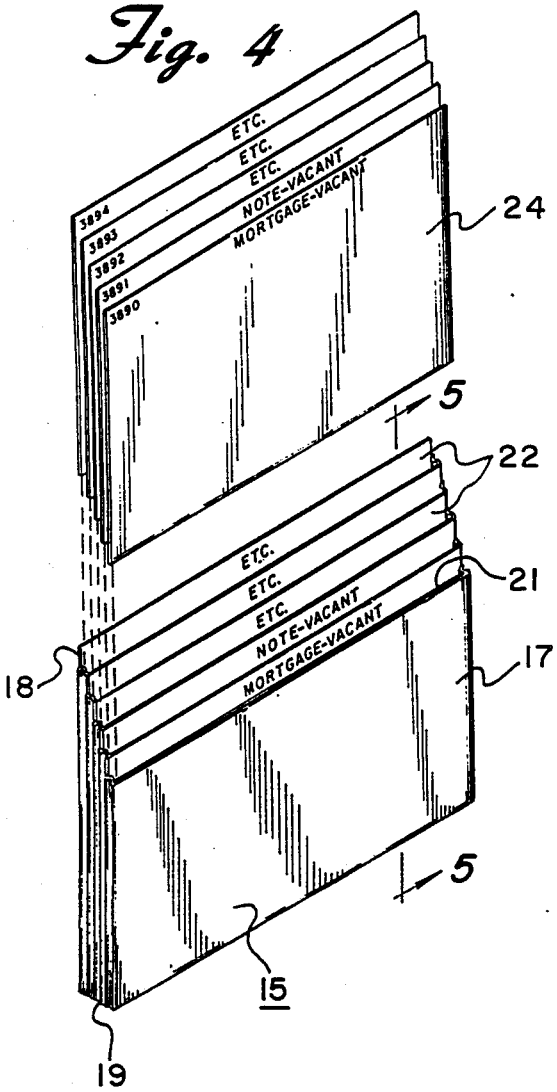
FIG. 4 is a perspective view of the file folder insert of the file folder of the present invention showing the documents to be filed within the pockets of the file folder prior to their insertion therein.

As shown in FIGS. 1, 2 and 4, various nomenclature may be placed upon the exposed edge 22 of a given pocket. For example, in a business environment where the file folder would be used for home mortgages, such nomenclature could be, for example, mortgage, note, etc.

Figure 3:
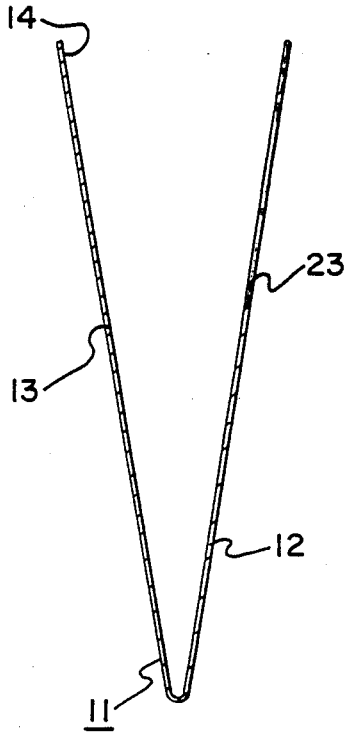
FIG. 3 is a sectional end view of the file jacket of the file folder of the present invention taken along the line 3—3 of FIG. 2.

Referring now to FIGS. 2 and 3, the front panel 12 of the file jacket 11 includes therein a window 23. The window 23 is of a height and width and positioned within the front panel 12 such that all of the nomenclature upon the exposed edges 22 of the insert pockets 21 will be visible.

Referring now to FIG. 4, there is illustrated the manner in which various documents 24, which are to be filed, are inserted within the insert pockets of the file folder insert 15. The documents themselves will have like nomenclature as to that on the exposed edges 22 of the insert pockets 21. However, the nomenclature associated with the exposed edges 22 of the insert pockets 21 will have additional nomenclature such as—vacant—associated with the nomenclature. Thus, when the file folder is in use as shown in FIG. 1, the file folder may remain closed and the user of the file may look through the window 23 and observe the nomenclature appearing through the window. For those insert pockets 21 in which there are present documents, the presence of that document will be readily available inasmuch as the nomenclature—vacant—will not be apparent. In the converse for those insert pockets from which documents are absent, the absence of such documents will be immediately apparent due to the appearance of the nomenclature—vacant—associated with the particular insert pocket. Thus, in the situation as shown in FIG. 1, it is readily evident that the note is missing whereas the mortgage is present within the file folder.

The file folder of the present invention may be made of any suitable material such as heavy paper stock, plastic or the like. The window 23 within the front panel 12 of the file jacket may be completely open as a simple cut out or, if preferred, a transparent material may be secured over the cut out for greater protection of the documents within the file folder.

The embodiment shown in FIGS. 1-5A of the drawings relies upon the user's visual observation of the presence or absence of documents. However, it is further contemplated that the presence or absence of documents within the file folder may be determined mechanically. For example, various types of machine readable encoding may be applied both to the outer file folder and to the documents therein for detection by various mechanical devices such as magnetic readers, optical readers and bar code readers. Thus, with such encoding upon the file, the file need only be passed by the particular reading device employed to determine such information as the identity of the particular file and the presence or absence of documents therein. In this manner, a large number of files may be quickly passed through the mechanical reading means to provide a computer print out of the status of the various files with any given office.

From the foregoing, it will be appreciated that the multi-document file folder of the present invention provides a file folder in which a plurality of documents may be conveniently and easily filed and the contents of the file visually or mechanically determined without opening the file.

While preferred embodiments of the present invention have been described in detail, various modifications, alterations and changes may be made without departing from the spirit and scope of the present invention as defined in the appended claims.

I claim:

1. A multi-document file folder comprising:

an outer file jacket having front and rear panels; joined at their bottom edges:

a separate multi-pocket file folder insert adapted to be freely positioned within the file jacket and having insert pockets of the same predetermined depth but staggered vertically upwardly in a rearward direction to expose the upper edges of the pockets one behind the other; and a window within the front panel of the file jacket in alignment with the upper edges of the file folder insert pockets when the file folder insert rests upon the bottom edges of the front and rear panels whereby the presence or absence of documents filed within the respective insert pockets will be visible without the necessity of opening the file folder.

2. The file folder of claim 1 further including document nomenclature on the upper edges of the file folder insert pockets for document identification.

3. The file folder of claim 1 wherein the depth of the respective insert pockets in relationship to the documents to be filed within a given insert pocket is such that one edge of the document will be exposed along the upper edge of the insert pocket.

4. The file folder of claim 3 further including machine readable encoding material positioned upon the exposed edges of the file documents to provide automatic machine identification of the filed or missing documents.

* * * * *